United States Patent [19]

Hotomi et al.

[11] Patent Number: 4,876,168

[45] Date of Patent: Oct. 24, 1989

[54] PHOTOSENSITIVE MEMBER COMPRISING CHARGE GENERATING LAYER AND CHARGE TRANSPORTING LAYER COMPRISING AMORPHOUS CARBON CONTAINING CHALOGEN OR TRANSITION METAL

[75] Inventors: Hideo Hotomi; Izumi Osawa; Syuji Iino; Isao Doi; Masanori Fujiwara, all of Osaka, Japan

[73] Assignee: Minolta Camera Kabushiki Kaisha, Osaka, Japan

[21] Appl. No.: 210,788

[22] Filed: Jun. 24, 1988

[30] Foreign Application Priority Data

Jun. 26, 1987 [JP] Japan ..... 62-159953
Jun. 26, 1987 [JP] Japan ..... 62-159954

[51] Int. Cl.[4] ..... G03G 5/085
[52] U.S. Cl. ..... 430/58; 430/84; 430/95
[58] Field of Search ..... 430/58

[56] References Cited

U.S. PATENT DOCUMENTS 4,743,522 5/1988 Iino ..... 430/58

FOREIGN PATENT DOCUMENTS 207143 10/1985 Japan .
62-27748 2/1987 Japan .
62-31862 2/1987 Japan .

*Primary Examiner*—J. David Welsh
*Attorney, Agent, or Firm*—Burns, Doane, Swecker & Mathis

[57] ABSTRACT

A photosensitive member comprising an electrically conductive substrate, a charge generating layer and a charge transporting layer comprising amorphous carbon which contains hydrogen.

The charge transporting layer contains about 0.1 to about 10 atomic % of chalcogen atoms or transition metal elements based on all the constituent atoms therein.

The photosensitive member of this construction is excellent in electrophotographic characteristics inclusive of charge transportability and charging ability.

3 Claims, 3 Drawing Sheets

PHOTOSENSITIVE MEMBER COMPRISING CHARGE GENERATING LAYER AND CHARGE TRANSPORTING LAYER COMPRISING AMORPHOUS CARBON CONTAINING CHALOGEN OR TRANSITION METAL

BACKGROUND OF THE INVENTION

1. Field of the Invention

The present invention relates to a photosensitive member having an amorphous carbon layer as a charge transporting layer.

2. Description of the Prior Arts

Remarkable progress has been made in the application of electrophotographic techniques since the invention of the Carlson process. Various materials have also been developed for use in electrophotographic photosensitive members.

Conventional photoconductive materials chiefly include inorganic compounds such as amorphous selenium, seleniumarsenic, selenium-tellurium, zinc oxide, amorphous silicon and the like, and organic compounds such as polyvinylcarbazole, metal phthalocyanine, disazo pigments, tris-azo pigments, perillene pigments, triphenymethanes, triphenylamines, hydrazones, styryl compounds, pyrazolines, oxazoles oxadiazoles and the like. The structures of photosensitive members include, for example, those of the single-layer type wherein such a material is used singly, the binder type wherein the material is dispersed in a binder, and the function-separated type comprising a charge generating layer and a charge transporting layer.

However, conventional photoconductive materials have various drawbacks. For example, the above-mentioned inorganic materials except for amorphous silicon (a-Si) are harmful to the human body.

The electrophotographic photosensitive member, when employed in a copying apparatus, must always have stabilized characteristics even if it is subjected to the severe environmental conditions of charging, exposure, developing, image transfer, removal of residual charges and cleaning, whereas the foregoing organic compounds have poor durability and many unstable properties.

In order to eliminate these drawbacks, progress has been made in recent years in the application of a-Si formed by the glow discharge process to electrophotographic photosensitive members as a material with reduced harmfulness, higher sensitivity and higher durability. Nevertheless, a-Si is hazardous to manufacture since it requires highly ignitable silane gas as its starting material. Moreover, a-Si requires a large quantity of silane gas which is expensive, rendering the resulting photosensitive member exceedingly more costly than conventional photosensitive members. The manufacture of photosensitive members of a-Si involves many disadvantages. For example, a-Si is low in film-forming speed and releases a large amount of explosive undecomposed silane products in the form of particles when forming a film. Such particles, when incorporated into the photosensitive member being produced, gives a seriously adverse influence on the quality of images to be obtained. Further, a-Si has a low chargeability due to its original high relative dielectric constant This necessitates the use of a charger of higher output for charging the a-Si photosensitive member to a predetermined surface potential in the copying apparatus.

On the other hand, it has been proposed in recent years to use plasma-polymerized films for photosensitive members.

Plasma-polymerized organic films per se have been wellknown for a long time. In Journal of Applied Polymer Science, Vol. 17, pp. 885–892, 1973, for example, M. Shen and A. T. Bell state that a plasma-polymerized organic film can be produced from the gas of any organic compound. The same authors discuss film formation by plasma polymerization in "Plasma Polymerization," published by the American Chemical Society in 1979.

However, the plasma-polymerized organic films prepared by the conventional process have been used only as insulating films. They are thought to be insulating films having a specific resistivity of about $10^{16}$ ohm-cm like usual polyethylene films, or are used as recognized at least as such. The use of the film for electrophotographic photosensitive members is based also on the same concept; the film has found limited use only as an undercoat or overcoat serving solely as a protective layer, adhesion layer, blocking layer or insulating layer.

For example, Unexamined Japanese Patent Publication SHO 59-28161 discloses a photosensitive member which comprises a plasma-polymerized high polymer layer of reticular structure formed on a substrate and serving as a blocking-adhesion layer, and an a-Si layer formed on the polymer layer. Unexamined Japanese Patent Publication SHO 59-38753 discloses a photosensitive member which comprises a plasma-polymerized film having a thickness of 10 to 100 angstroms and formed over a substrate as a blocking-adhesion layer, and an a-Si layer formed on the film, the plasma-polymerized film being prepared from a gas mixture of oxygen, nitrogen and a hydrocarbon and having a high resistivity of $10^{13}$ to $10^{15}$ ohm-cm. Unexamined Japanese Patent Publication SHO 59-136742 discloses a photosensitive member wherein an aluminum substrate is directly coated with a carbon film having a thickness of about 1 to about 5 microns and serving as a protective layer for preventing aluminum atoms from diffusing through an a-Si layer formed over the substrate when the member is exposed to light. Unexamined Japanese Patent Publication SHO 60-63541 discloses a photosensitive member wherein a diamond-like carbon film, 200 angstroms to 2 microns in thickness, is interposed between an aluminum substrate and an overlying a-Si layer to serve as an adhesion layer to improve the adhesion between the substrate and the a-Si layer. The publication says that the film thickness is preferably up to 2 microns in view of the residual charge.

These disclosed inventions are all directed to a so-called undercoat provided between the substrate and the a-Si layer. In fact, these publications mention nothing whatever about charge transporting properties, nor do they offer any solution to the foregoing substantial problems of a-Si.

Furthermore, Japanese Unexamined Patent Publication No. SHO 50-20728, for example, discloses a photosensitive member of the polyvinylcarbazole-selenium type coated with a polymer film having a thickness of 0.1 to 1 microns and formed by glow discharge polymerization as a protective layer. Unexamined Japanese Patent Publication SHO 59-214859 discloses a technique for protecting the surface of an a-Si photosensitive member with an approximately 5-micron-thick film formed by plasma-polymerizing an organic hydrocarbon monomer such as styrene or acetylene. Unexamined Japanese Patent Publication SHO 60-61761 discloses a photosensitive member having a diamond-like carbon thin film 500 angstroms to 2 microns in thickness and serving as a surface protective layer, it being preferred that the film thickness be up to 2 microns in view of transmittancy. Unexamined Japanese Patent publication SHO 60-249115 discloses a technique for forming a film of amorphous carbon or hard carbon with a thickness of about 0.05 to about 5 microns for use as a surface protective layer. The publications states that the film adversely affects the activity of the protected photosensitive member when exceeding 5 microns in thickness.

These disclosed inventions are all directed to a so-called overcoat formed over the surface of the photosensitive member. The publications disclose nothing whatever about charge transporting properties, nor do they solve the aforementioned substantial problems of a-Si in any way.

Unexamined Japanese Patent Publication SHO 51-46130 discloses an electrophotographic photosensitive member of the polyvinylcarbazole type which has a polymer film 0.001 to 3 microns in thickness and formed on its surface by being subjected to glow discharge polymerization. Nevertheless, the publication is totally mute about charge transporting properties, further failing to solve the foregoing substantial problems of a-Si.

Thus, the conventional plasma-polymerized organic films for use in electrophotographic photosensitive members are used as undercoats or overcoats because of their insulating properties and need not have a carrier transporting function. Accordingly, the films used are limited in thickness to a very small value of up to about 5 microns if largest. Carriers pass through the film owing to a tunnel effect, while if the tunnel effect is not expectable, the film used has such a small thickness that will not pose problems actually as to the occurrence of a residual potential.

With electrophotographic photosensitive member of the function-separated type, the charge transporting layer must have a high ability to transport carriers and needs to be at least $10^{-7}$ $cm^2/V/sec$ in carrier mobility Further, to be satisfactorily usable to electrophotographic systems, the charge transporting layer must have excellent charging characteristics and be capable of withstanding a voltage of at least 10 $V/\mu m$. It is also desirable that the charge transporting layer have a specific dielectric constant of 6 or less to lessen the load on the charger.

SUMMARY OF THE INVENTION

In view of the foregoing problems, the main object of the present invention is to provide a photosensitive member which is generally excellent in electrophotographic characteristics and capable of giving satisfactory images.

Another objects of the invention is to provide a photosensitive member which is excellent in charge transportability and in charging characteristics.

Another object of the invention is to provide a photosensitive member which is free of a reduction in sensitivity and of residual potential and which retains sensitivity with high stability despite lapse of time.

Another object of the invention is to provide a photosensitive member which is excellent in durability, weather resistance, resistance to environmental pollution and light transmitting property.

These and other objects of the invention can be fulfilled by providing a photosensitive member which comprises a substrate, a charge generating layer and a charge transporting layer of amorphous carbon containing about 0.1 to 67 atomic % of hydrogen atoms based on the combined amount of carbon atoms and hydrogen atoms contained in the charge transporting layer and about 0.1 to 10 atomic % of chalcogen atoms or transition metal elements based on all the constituent atoms of the charge transporting layer.

DETAILED DESCRIPTION OF THE INVENTION

Figure 1:
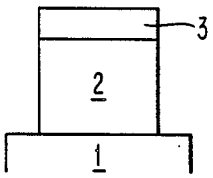
FIGS. 1 to 6 are diagrams showing photosensitive members embodying the invention.

The present invention relates to a photosensitive member which is characterized in that it comprises as a charge transporting layer an organic plasma-polymerized layer containing at least about 0.1 to 10 atomic % of chalcogen atoms or transition metal elements as a chemical modifier formed via a plasma polymerization reaction of an organic gas under low pressure The amount of carbon, hydrogen and chalcogen atoms or transition metal elements contained in the amorphous carbon layer (hereinafter be referred to as "a-C layer") of the present invention is ascertainable by means of conventional elementary analysis, for example, organic elementary analysis, Auger electron spectroscopy or like methods. The charge transporting layer does not exhibit distinct photoconductive properties when exposed to visible light or light in the vicinity of semiconductor laser beams in wavelength, but has suitable ability to transport charges and is excellent in characteristics for use in electrophotographic photosensitive members, e.g. in chargeability, durability and resistance to moisture, weather and environmental pollution, and also in transmittance. The layer therefore affords a high degree of freedom also in providing laminate structures for use as photosensitive members of the function-separated type.

We have conducted research on the application of organic plasma-polymerized layers to photosensitive members and found that an organic polymerized layer which is originally thought to be an insulating layer, exhibits ability to transport charges with a reduced specific resistivity when prepared by adding chalcogen atoms or transition metal elements as a chemical modifier Although much still remains to be clarified in detail for the theoretical interpretation of this finding, the result will presumably be attributable to electrons in a relatively unstable state, such as $\pi$-electrons, unpaired electrons, remaining free radicals and the like, which are captured in the charge generating layer and which effectively contribute to charge transportability owing to polarization or a change in stereo structure or the like due to the admixture of chalcogen atoms or transition metal elements.

The aforesaid polymer layer which lacks the added chalcogen atoms or transition metal elements readily exhibits reduced transportability over time, i.e. reduced sensitivity. It was found, however, that the addition of chalcogen atoms or transition metal elements as a chemical modifier prevented deterioration and maintained the stability of transportability in the charge transporting layer. Further, the addition of transition metal elements assures the photosensitive member of suitable light decay characteristics in the low potential region, with the light decay curve sharply sloping down in this region, producing a remarkable effect to inhibit the occurrence of residual potential. Moreover, the presence of chalcogen atoms greatly expedites the formation of the charge transporting layer which must have a considerable thickness, as required for efficient preparation of the layer.

According to the present invention, hydrocarbons are used as organic gases for forming the a-C layer. These hydrocarbons need not always be in a gaseous phase at room temperature at atmospheric pressure but can be in a liquid or solid phase insofar as they can be vaporized on melting, evaporation or sublimation, for example, by heating or in a vacuum. Examples of useful hydrocarbons are saturated hydrocarbons, unsaturated hydrocarbons, alicyclic hydrocarbons, aromatic hydrocarbons and the like.

A wide variety of hydrocarbons are usable. Examples of useful saturated hydrocarbons are normal paraffins such as methane, ethane, propane, butane, pentane, hexane, heptane, octane, nonane, decane, undecane, dodecane, tridecane, tetradecane, pentadecane, hexadecane, heptadecane, octadecane, nonadecane, eicosane, heneicosane, docosane, tricosane, tetracosane, pentacosane, hexacosane, heptacosane, octacosane, nonacosane, triacontane, dotriacontane, pentatriacontane, etc.; isoparaffins such as isobutane, isopentane, neopentane, isohexane, neohexane, 2,3-dimethylbutane, 2-methylhexane, 3-ethylpentane, 2,2-dimethylpentane, 2,4-dimethylpentane, 3,3-dimethylpentane, tributane, 2-methylheptane, 3-methylheptane, 2,2-dimethylhexane, 2,2,5-dimethylhexane, 2,2,3-trimethylpentane, 2,2,4-trimethylpentane, 2,3,3-trimethylpentane, 2,3,4-trimethylpentane, isononane, etc.; and the like.

Examples of useful unsaturated hydrocarbons are olefins such as ethylene, propylene, isobutylene, 1-butene, 2-butene, 1-pentene, 2-pentene, 2-methyl-1-butene, 3-methyl-1-butene, 2-methyl-2-butene, 1-hexene, tetramethylethylene, 1-heptene, 1-octene, 1-nonene, 1-decene and the like; diolefins such as allene, methyl-allene, butadiene, pentadiene, hexadiene, cyclopentadiene and the like; triolefins such as ocimene, alloocimene, myrcene, hexatriene and the like; acetylene, methylacetylene, 1-butyne, 2-butyne, 1-pentyne, 1-hexyne, 1-heptyne, 1-octyne, 1-nonyne, 1-decyne and the like.

Examples of useful alicyclic hydrocarbons are cycloparaffins such as cyclopropane, cyclobutane, cyclopentane, cyclohexane, cycloheptane, cyclooctane, cyclononane, cyclodecane, cycloundecane, cyclododecane, cyclotridecane, cyclotetradecane, cyclopentadecane, cyclohexadecane and the like; cycloolefins such as cyclopropene, cyclobutene, cyclopentene, cyclohexene, cycloheptene, cyclooctene, cyclononene, cyclodecene and the like; terpenes such as limonene, terpinolene, phellandrene, sylvestrene, thujene, carene, pinene, bornylene, camphene, fenchene, cyclofenchene, tricyclene, bisabolene, zingiberene, curcumene, humulene, cadinenesesquibenihene, selinene, caryophyllene, santalene, cedrene, camphorene, phyllocladene, podocarprene, mirene and the like; steroids; etc.

Examples of useful aromatic hydrocarbons are benzene, toluene, xylene, hemimellitene, pseudocumene, mesitylene, prehnitene, isodurene, durene, pentamethylbenzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene and the like.

The a-C layer of the present invention contains 0.1 to 67 atomic %, preferably 30 to 60 atomic %, of hydrogen atoms based on the combined amount of carbon and hydrogen atoms present. If the amount of hydrogen atoms is less than 0.1 atomic %, reduced transportability will result, failing to give suitable sensitivity, whereas amounts of hydrogen atoms exceeding 67 atomic % entail reduced chargeability and impaired film-forming ability.

The hydrogen content of the a-C layer of the invention is variable in accordance with the film forming apparatus and film forming conditions. The hydrogen content can be decreased, for example, by elevating the substrate temperature, lowering the pressure, reducing the degree of dilution of the starting materials, applying a greater power, decreasing the frequency of the alternating electric field to be set up, increasing the intensity of a d.c. electric field superposed on the alternating electric field or desired combination of such procedures.

It is suitable that the a-C layer serving as the charge transporting layer of the invention be 5 to 50 microns, preferable 7 to 20 microns, in thickness for use in the usual electrophotographic process. Thicknesses smaller than 5 microns result in a lower charge potential, failing to give a sufficient copy image density, whereas thicknesses larger than 50 microns are not desirable in view of productivity The a-C layer is high in transmittancy, dark resistivity and charge transportability, traps no carriers even when not smaller than 5 microns in thickness as mentioned above and contributes to light decay.

According to the present invention, chalcogen compounds or transition metal compounds are used in addition to hydrocarbons in order to incorporate chalcogen atoms or transition metal elements into the a-C layer. The chalcogen compounds and transition metal compounds need not always be in a gas phase at room temperature at atmospheric pressure but can be a liquid or solid provided that the compound can be vaporized on melting, evaporation or sublimation, for example, when heated or subjected to a vacuum.

Examples of molecules containing at least chalcogen atoms are $H_2S$, $CH_3(CH_2)_4S(CH_2)_4CH_3$, $CH_2{=}CHCH_2SCH_2CH{=}CH_2$, $C_2H_5SC_2H_5$, $C_2H_5SCH_3$, thiophene, $H_2Se$, $(C_2H_5)_2Se$, $H_2Te$ and the like.

Transition metal elements may be atoms having atomic number of 21(Sc) to 29(Cu), 39(Y) to 47(Ag), 57(La) to 79(Au) and 89(Ac) to 103(Lr). However, there is a limited number of usable and obtainable atoms Examples of usable atoms may be atoms having atomic number of 21 to 29, 39 to 47 and 57 to 79.

Examples of useful transition metal compounds are organic compounds such as metal alcoholate, metal acrylic acid, metal methacrylic acid, metal vinyl, metal carbonyl, metal ion, metal hydride, metal azide, metal amide, metal phthalocyanine and the like.

According to the present invention, the gases of starting materials are made into an a-C layer, most preferably via a plasma which is produced by d.c. low- or high-frequency, microwave or like plasma process. Alternatively, the layer may be formed via ions which are produced by the ionization deposition, ion-beam deposition or like process, or via neutral particles produced by the vacuum evaporation process, sputtering process or the like. These processes may be used in combination.

Chalcogen atoms or transition metal elements, serving as another chemically modifying substance, are preferably incorporated in the a-C layer in an amount of about 0.1 to 10 atomic %, more preferably about 0.5 to 9 atomic %, based on all the constituent atoms of the layer. The layer without incorporating chalcogen atoms and transition metal elements does not assure suitable charge transportability, is low in film-forming speed and readily exhibits deterioration over time. If the chalcogen atom content exceeds 10 atomic %, the chalcogen which assures suitable charge transportability when present in a suitable amount conversely impairs the chargeability, further acting to lower the resistivity of the layer. The photosensitive member having transition metal element content of more than 10 atomic % does not assure film formability, causing separation of the layer and producing oily or powdery layer.

The quantity of chalcogen atoms or transition metal elements to be contained in the layer and serving as a chemically modifying substance is controllable primarily by varying the amount of the chalcogen compounds or transition metal compounds to be introduced into a reactor for plasma polymerization. The use of an increased quantity of chalcogen compounds or transition metal compounds gives a higher chalcogen atom or transition metal element content to the a-C layer of the invention, whereas a decreased quantity of chalcogen compounds or transition metal compounds results in a lower chalcogen atom or transition metal element content.

The charge generating layer to be incorporated into the photosensitive member of the present invention is not limited specifically in its material. Examples of materials that are usable are inorganic substances such as amorphous selenium, selenium-arsenic, selenium-tellurium, cadmium sulfide, zinc oxide, and amorphous silicon which contains different elements (e.g. hydrogen, boron, carbon, nitrogen, oxygen, fluorine, phosphorus, sulfur, chlorine, bromine, germanium, etc.) for giving altered characteristics, and organic substances such as polyvinylcarbazole, cyanine compounds, metal phthalocyanine compounds, azo compounds, perillene compounds, triarylmethane compounds, triphenylmethane compounds, triphenylamine compounds, hydrazone compounds, styryl compounds, pyrazoline compounds, oxazole compounds, oxaazine compounds, oxadiazole compounds, thiazine compounds, xanthene compounds, pyrylium compounds, quinacridoe compounds, indigo compounds, polycyclic quinone compounds, disbenzimidazole compounds, indanthrone compounds and squalylium compounds. Other substances are also usable insofar as they are capable of efficiently producing optically excited carriers when exposed to light and efficiently injecting the carriers into the charge transporting layer.

The process for preparing the charge generating layer is not limited specifically. For example, this layer may be formed by th same process as the charge transporting layer (a-C layer) of the invention, electro-deposition in a liquid phase, spraying, dipping or like coating process, or the like. The same process as employed for preparing the charge transporting layer of the invention is desirable because of a reduced equipment cost and savings in labor.

The photosensitive member of the present invention comprises a charge generating layer and a charge transporting layer of the type described above, which are formed in a superposed structure suitably determined as required.

Figure 2:
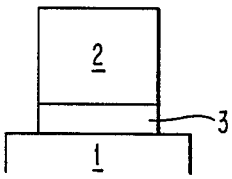
Figure 3:
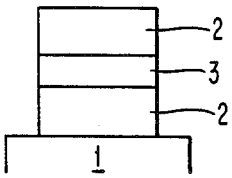

FIG. 1 shows a photosensitive member of one type comprising an electrically conductive substrate 1, a charge transporting layer 2 formed on the substrate and a charge generating layer 3 formed on the layer 2. FIG. 2 shows another type comprising an electrically conductive substrate 1, a charge generating layer 3 on the substrate and a charge transporting layer 2 on the layer 3. FIG. 3 shows another type comprising an electrically conductive substrate 1, and a charge transporting layer 2, a charge generating layer 3 and another charge transporting layer 2 formed over the substrate and arranged one over another.

These photosensitive members are used, for example, by positively charging the surface with a corona charger or the like and exposing the charged surface to an optical image. In the case of FIG. 1, the holes then generated in the charge generating layer 3 travel through the charge transporting layer 2 toward the substrate 1. In FIG. 2, the electrons generated in the charge generating layer 3 travel through the charge transporting layer 2 toward the surface of the photosensitive member. In FIG. 3, the holes generated in the charge generating layer 3 travel through the lower charge transporting layer 2 toward the substrate 1, and at the same time, the electrons generated in the charge generating layer 3 travel through the upper transporting layer 2 toward the surface of the member. Consequently, an electrostatic latent image is formed, with satisfactory light decay assured. Conversely, when the surface of the photosensitive member is negatively charged and then exposed, the electron and the hole may be replaced by each other in respect of the above behavior for the interpretation of the travel of carriers. With the structures of FIGS. 2 and 3, the image projecting light passes through the charge transporting layer, which nevertheless has high transmittancy, permitting satisfactory formation of latent image.

Figure 4:
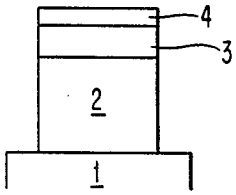

FIG. 4 shows another type comprising an electrically conductive substrate 1, and a charge transporting layer 2, a charge generating layer 3 and a charge transporting layer 4 provided over the substrate and arranged one over another. Thus, the illustrated structure corresponds to the structure of FIG. 1 provided with a surface protective layer. Since the outermost surface of the structure of FIG. 1 is provided by a charge generating of a-Si having poor humidity resistance in the present invention, it is generally desirable that the surface be covered with a protective layer for assuring stability toward humidity. With the structures of FIGS. 2 and 3, the charge transporting layer embodying the invention and having high durability provides the outermost surface, so that the surface protective layer need not be provided. However, such a photosensitive member can be formed with a surface protective layer as another type so as to be compatible with various other elements within the copying machine, for example, to be free from surface soiling deposition of developer.

Figure 5:
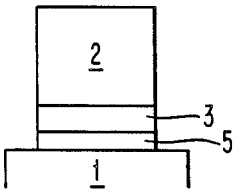

FIG. 5 shows another type comprising an electrically conductive substrate 1, and an intermediate layer 5, a charge generating layer 3 and a charge transporting layer 2 which are formed over the substrate and arranged one over another. Thus, this structure corresponds to the structure of FIG. 2 provided with an intermediate layer. Since a charge generating layer is joined to the substrate in the structure of FIG. 2, it is generally desirable to interpose an intermediate layer therebetween to assure good adhesion and an injection inhibitory effect. With the structures of FIGS. 1 and 3, the charge transporting layer of the invention which is excellent in adhesion and injection inhibitory effect is joined to the substrate, so that no intermediate layer may be provided. However, the photosensitive member of either of these types can be formed with an intermediate layer in order to render the transporting layer to be formed compatible with the preceding fabrication step, such as pretreatment of the conductive substrate. Another type of photosensitive member is then available.

Figure 6:
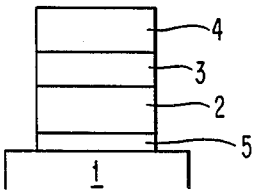

FIG. 6 shows still another type comprising an electrically conductive substrate 1, and an intermediate layer 5, a charge transporting layer 2, a charge generating layer 3 and a surface protective layer 4 which are formed over the substrate and superposed one over another. Thus, this structure corresponds to the structure of FIG. 1 provided with an intermediate layer and a surface protective layer. The intermediate and protective layers are formed for the same reasons as already stated. Thus, the provision of these two layers in the structure of FIGS. 2 or 3 affords another type.

According to the present invention, the intermediate layer and the surface protective layer are not limited specifically in material or fabrication process. Any material or process is suitably selectable provided that the contemplated object can be achieved. The a-C layer of the invention may be used. However, if the material to be used is an insulating material such as one already mentioned, the thickness of the layer needs to be up to 5 microns to preclude occurrence of residual potential.

The charge transporting layer of the photosensitive member embodying the present invention is produced by so-called plasma polymerization wherein molecules in a vapor phase are subjected to discharge decomposition in a vacuum phase, and the active neutral seeds or charge seeds contained in the resulting atmosphere of plasma are led onto a substrate by diffusion or an electric or magnetic force and accumulated into a solid phase on the substrate through a rebinding reaction.

Figure 7:
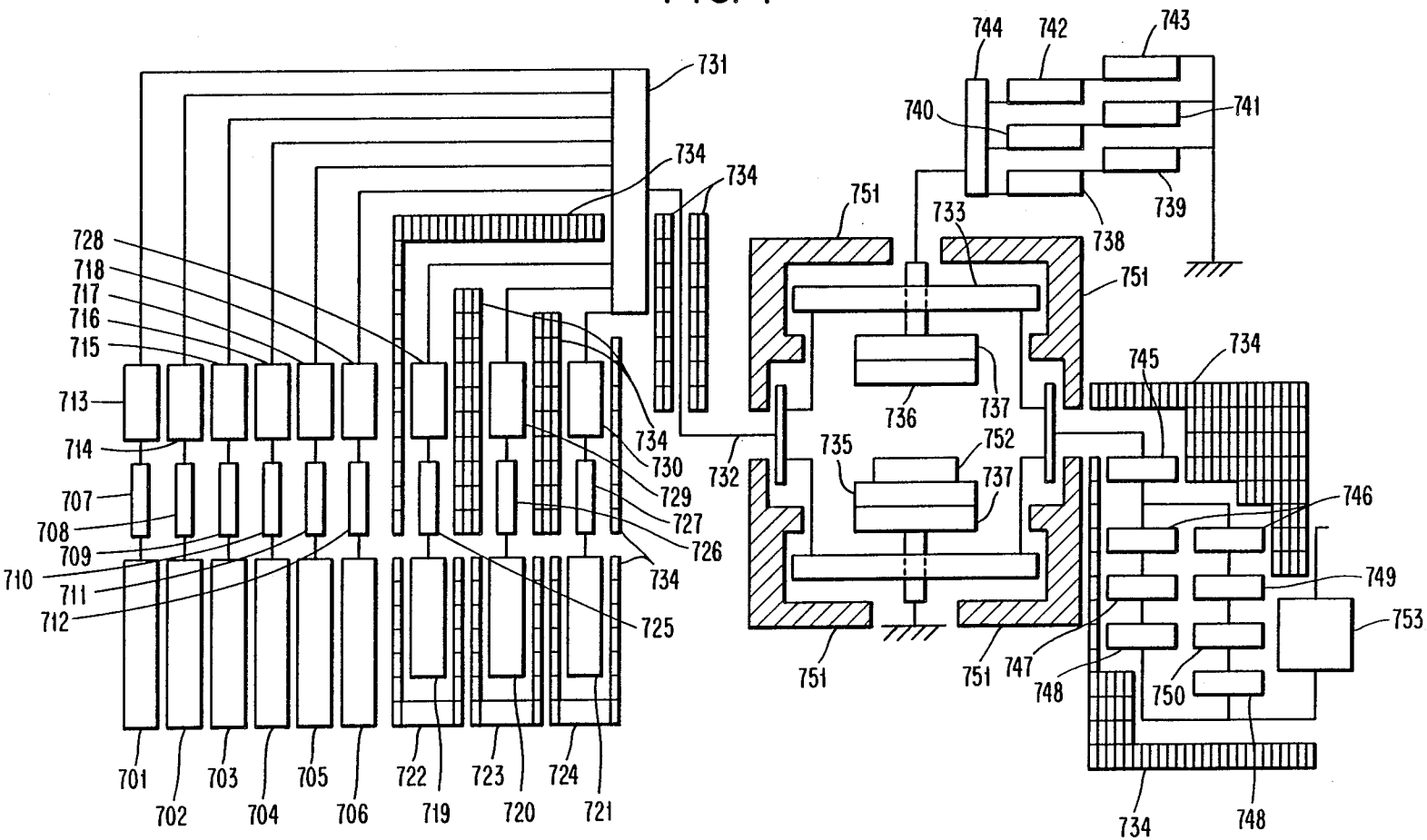
FIGS. 7 and 8 are diagrams showing apparatus for preparing photosensitive members of the invention.

FIG. 7 shows an apparatus for preparing the photosensitive member of the invention. First to sixth tanks 701 to 706 have enclosed therein starting material compounds which are in gas phase at room temperature and a carrier gas and are connected respectively to first to sixth regulator valves 707 to 712 and first to sixth flow controllers 713 to 718. First to third containers 719 to 721 contain starting material compounds which are liquid or solid at room temperature, can be preheated by first to third heaters 722 to 724 for vaporizing the compounds, and are connected to seventh to ninth regulator valves 725 to 727 and seventh to ninth flow controllers 728 to 730, respectively. The gases to be used as selected from among these gases are mixed together by a mixer 731 and fed to a reactor 733 via a main pipe 732. The interconnecting piping can be heated by a pipe heater 734 which is suitably disposed so that the material compound, in a liquid or solid phase at room temperature and vaporized by preheating, will not condense during transport. A grounded electrode 735 and a power application electrode 736 are arranged as opposed to each other within the reactor 733. Each of these electrodes can be heated by an electrode heater 737. The power application electrode 736 is connected to a high-frequency power source 739 via a high-frequency power matching device 738, to a low-frequency power source 741 via a low-frequency power matching device 740 and to a d.c. power source 743 via a low-pass filter 742. Power of one of the different frequencies is applicable to the electrode 736 by way of a connection selecting switch 744. The internal pressure of the reactor 733 is adjustable by a pressure control valve 745. The reactor 733 is evacuated by a diffusion pump 747 and an oil rotary pump 748 via an exhaust system selecting valve 746, or by a cooling-removing device 749, a mechanical booster pump 750 and an oil rotary pump 748 via another exhaust system selecting value 746. The exhaust gas is further made harmless by a suitable removal device 753 and then released to the atmosphere. The evacuation piping system can also be heated by a suitably disposed pipe heater 734 so that the material compound which is liquid or solid at room temperature and vaporized by preheating will not condense during transport. For the same reason, the reactor 733 can also be heated by a reactor heater 751. An electrically conductive substrate 752 is placed on the electrode 735 in the reactor. Although FIG. 7 shows that the substrate 752 is fixed to the grounded electrode 735, the substrate may be attached to the power application electrode 736, or to both the electrodes.

Figure 8:
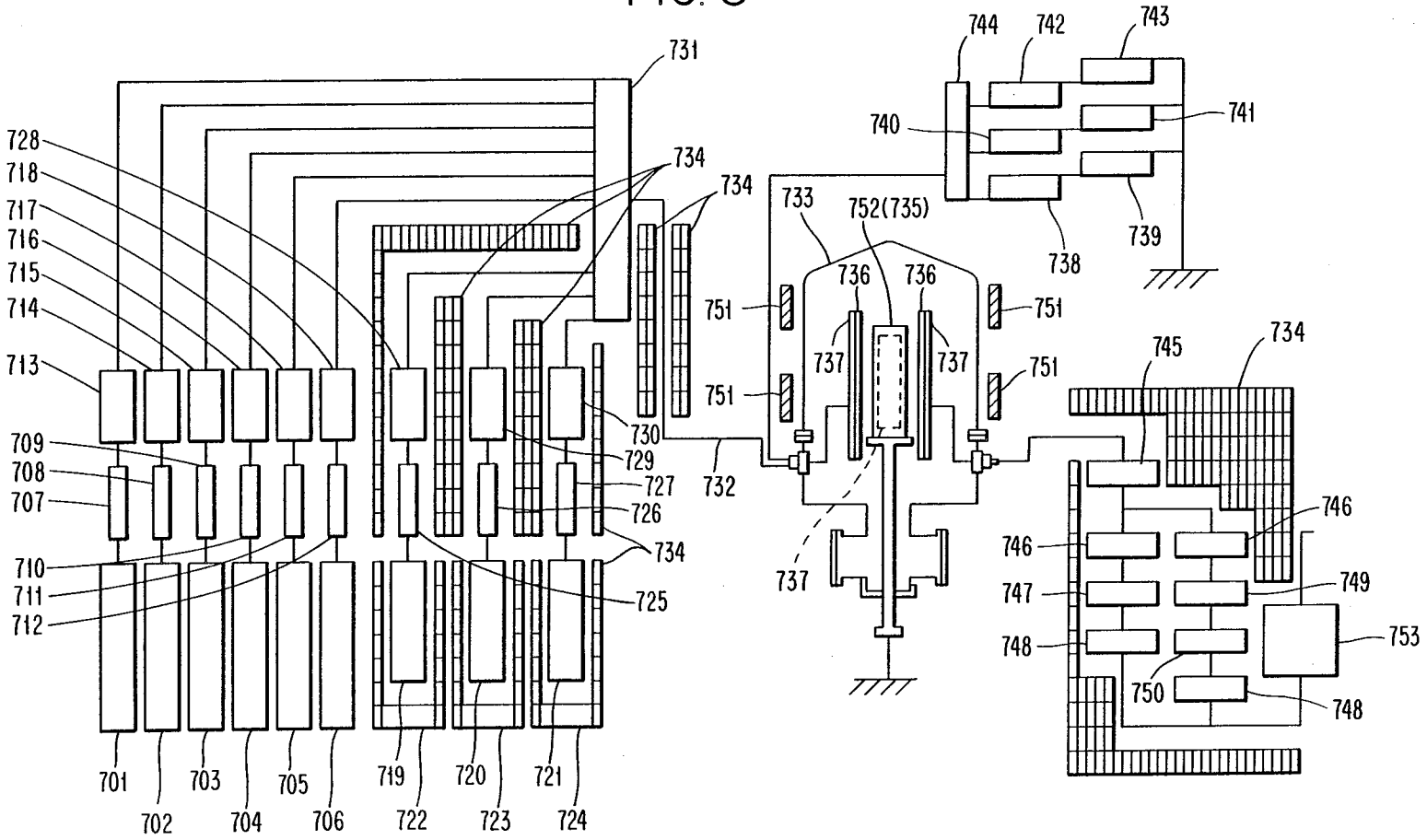

FIG. 8 shows another type of apparatus for preparing the photosensitive member of the invention. This apparatus has the same construction as the apparatus of FIG. 7 with the exception of the interior arrangement of the reactor 733. With reference to FIG. 8, the reactor 733 is internally provided with a hollow cylindrical electrically conductive substrate 752 serving also as the grounded electrode 735 of FIG. 7 and with an electrode heater 737 inside thereof. A power application electrode 736, similarly in the form of a hollow cylinder, is provided around the substrate 752 and surrounded by an electrode heater 737. The conductive substrate 752 is rotatable about its own axis by motor from outside.

The reactor for preparing the photosensitive member is first evacuated by the diffusion pump to a vacuum of about $10^{-4}$ to about $10^{-6}$ torr, whereby the adsorbed gas inside the reactor is removed. The reactor is also checked for the degree of vacuum. At the same time, the electrodes and the substrate fixedly placed on the electrode are heated to a predetermined temperature. To obtain a photosensitive member of the desired one of the foregoing structures, an undercoat layer or a charge generating layer may be formed on the substrate before the charge transporting layer is formed when so required. The undercoat or charge generating layer may be formed by the present apparatus or by some other apparatus. Subsequently, material gases are fed into the reactor from the first to sixth tanks and the first to third containers (i.e. from those concerned), each at a specified flow rate, using the flow controllers concerned, i.e. first to ninth flow controllers and the interior of the reactor is maintained in a predetermined vacuum by the pressure control valve. After the combined flow of gases has become stabilized, the high-frequency power source, for example, is selected by the connection selecting switch to apply a high-frequency power to the power application electrode. This initiates discharge across the two electrodes, forming a solid layer on the substrate with time. The thickness of the layer is controllable by varying the reaction time, such that the discharge is discontinued upon the thickness reaching the desired value. Consequently, an a-C layer of the invention is obtained which serves as a charge transporting layer.

The a-C layer comprising hydrogen and carbon is characterized in that it is prepared by containing 0.1 to 67 atomic % of hydrogen atoms based on the combined amount of carbon and hydrogen and about 0.1 to 10 atomic % of chalcogen atoms or transition metal elements as a chemical modifier based on all the constituent atoms therein.

Next the regulator valves concerned are closed, and the reactor is thoroughly exhausted. When a photosensitive member of the desired structure has been formed according to the invention, the vacuum within the reactor is vitiated and the member is removed from the reactor. If another charge generating layer or overcoat layer are to be superposed on the above structure, such a layer is formed using the present apparatus as it is. Or the photosensitive member formed by the above process is taken out from the reaction chamber after destroying the vacuum, and is then transferred to another apparatus to form such a layer. Thus, the photosensitive member of the present invention can be obtained.

The present invention will be described with reference to the following examples.

EXAMPLE 1

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 7 was used. First, the interior of the reactor 733 was evacuated to a high vacuum of about $10^{-6}$ torr, and the first second and third regulator valves 707, 708 and 709 were thereafter opened to introduce hydrogen gas from the first tank 701 into the first flow controller 713, ethylene gas from the second tank 702 into the second flow controller 714 and $H_2S$ gas from the third tank 703 into the third flow controller 715, each at an output pressure of 1.0 kg/cm$^2$. The dials on the flow controllers were adjusted to supply the hydrogen gas at a flow rate of 40 sccm, the ethylene gas at 30 sccm and the $H_2S$ gas at 8 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate measuring 50 mm in length, 50 mm in width and 3 mm in thickness, was preheated to 250° C. With the gas flow rates and the pressure in stabilized state, 200-watt power with a frequency of 13.56 MHz was applied to the power application electrode 736 from the high-frequency power source 739 preconnected thereto by the selecting switch 744 to conduct plasma polymerization for 5 hours, forming an a-C layer, 7 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 52 atomic % of hydrogen atoms based on the combined amount of carbon atoms and hydrogen atom and 0.4 atomic % of chalcogen atoms, i.e., sulfur atoms based on all the constituent atoms therein.

Charge Generating Layer Forming Step (CGL)

Next, the first, fifth and sixth regulator valves 707, 711 and 712 were opened to introduce hydrogen gas from the first tank 701 into the first flow controller 713, nitrous oxide gas from the fifth tank 705 into the fifth flow controller 717 and silane gas from the sixth tank 706 into the sixth flow controller 718, each at an output pressure of 1.0 kg/cm$^2$. The dials on the flow controllers were adjusted to supply the hydrogen gas at a flow rate of 210 sccm, nitrous oxide gas at 1.0 sccm and the silane gas at 90 sccm to the reactor 733. After the flows of the gases stabilized, the internal pressure of the reactor 733 was adjusted to 0.8 torr by the pressure control valve 745. On the other hand, the substrate 752 formed with the a-C layer was preheated to 250° C. With the gas flow rates and the pressure in stabilized state, 35-watt power with a frequency of 13.56 MHz was applied to the power application electrode 736 from the high-frequency power source 739 to effect glow discharge for 5 minutes, whereby a charge generating a-Si:H layer was formed with a thickness of 0.3 microns.

Characteristics

When the photosensitive member obtained was used for the usual Carlson process, the member showed a maximum charge potential (hereinafter referred to as Vmax) of −600 V Specifically, the chargeability per 1 micron (hereinafter referred to as C.A.) was 82 V by calculating from the entire thickness of the member, i.e. 7.3 microns, indicating that the member had satisfactory charging properties.

The period of time required for dark decay from −600 V to −550 V was about 15 seconds, showing that the member had satisfactory charge retentivity.

When the member was initially charged to −500 V and thereafter exposed to white light to decay the charge to −100 V, the amount of light required for the light decay was about 5.7 lux-sec. This revealed that the member was satisfactory in photosensitive characteristics. The amount of light required for the light decay as described above was about 6.0 lux-sec. after three months upon the formation of the present photosensitive member. This showed that the member had stabilized characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 2

The photosensitive member was prepared by exactly the same process as in Example 1 except that the flow rate of $H_2S$ gas was set to 15 sccm.

The thickness of the a-C layer is 7.9 microns. When subjected to CHN quantitative analysis, the a-C layer thus obtained was found to contain 54 atomic % of hydrogen atoms based on the combined amount of carbon atoms and hydrogen atoms and 0.99 atomic % of chalcogen atoms, i.e., sulfur atoms based on all the constituent atoms therein.

Characteristics

When the photosensitive member obtained was used for the usual Carlson process, the member showed a Vmax of −630 V. Specifically, the C.A. was 77 V by calculating from the entire thickness of the member, i.e. 8.2 microns, indicating that the member had satisfactory charging properties.

The period of time required for dark decay from −600 V to −550 V was about 20 seconds, showing that the member had satisfactory charge retentivity.

When the member was initially charged to −500 V and thereafter exposed to white light to decay the charge to −100 V, the amount of light required for the light decay was about 3.2 lux-sec. This revealed that the member was satisfactory in photosensitive characteristics. The amount of light required for the light decay as described above was about 3.5 lux-sec. after three months upon the formation of the present photosensitive member This showed that the member had stabilized characteristics over a prolonged period of time free of deterioration despite lapse of time.

These results indicate that the photosensitive member prepared in the present example according to the invention exhibits outstanding performance When the member was used in the Carlson process for forming images thereon, followed by image transfer, sharp copy images were obtained.

EXAMPLE 3

The photosensitive member was prepared by exactly the same process as in Example 1 except that the flow rate of $H_2S$ gas was set to 40 sccm.

When subjected to CHN quantitative analysis, the a-C layer thus obtained was found to contain 53 atomic % of hydrogen atoms based on the combined amount of carbon atoms and hydrogen atoms and 5.0 atomic % of chalcogen atoms i.e., sulfur atoms based on all the constituent atoms therein. Moreover, the thickness of the a-C layer was 8.3 microns.

Characteristics

When the photosensitive member obtained was used for the usual Carlson process, the member showed a Vmax of −600 V. Specifically, the C.A. was 70 V by calculating from the entire thickness of the member, i.e. 8.6 microns, indicating that the member had satisfactory charging properties.

The period of time required for dark decay from −600 V to −550 V was about 25 seconds, showing that the member had satisfactory charge retentivity.

When the member was initially charged to −500 V and thereafter exposed to white light to decay the charge to −100 V, the amount of light required for the light decay was about 4.2 lux-sec. This revealed that the member was satisfactory in photosensitive characteristics The amount of light required for the light decay as described above was about 4.7 lux-sec. after three months upon the formation of the present photosensitive member This showed that the member had stabilized characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 4

The photosensitive member was prepared by exactly the same process as in Example 1 except that the flow rate of $H_2S$ gas was set to 120 sccm.

When subjected to CHN quantitative analysis, the a-C layer thus obtained was found to contain 52 atomic % of hydrogen atoms based on the combined amount of carbon atoms and hydrogen atoms and 9.2 atomic % of chalcogen atoms, i.e., sulfur atoms based on all the constituent atoms therein. Moreover, the thickness of the a-C layer was 9.2 microns.

Characteristics

When the photosensitive member obtained was used for the usual Carlson process, the member showed a Vmax of −500 V. Specifically, the C.A. was 53V by calculating from the entire thickness of the member, i.e. 9.5 microns, indicating that the member had satisfactory charging properties.

The period of time required for dark decay from −500 V to −450 V was about 20 seconds, showing that the member had satisfactory charge retentivity.

When the member was initially charged to −500 V and thereafter exposed to white light to decay the charge to −100 V, the amount of light required for the light decay was about 8.9 lux-sec. This revealed that the member was satisfactory in photosensitive characteristics. The amount of light required for the light decay as described above was about 9.9 lux-sec. after three months upon the formation of the present photosensitive member. This showed that the member had stabilized characteristics over a prolonged period of time free of deterioration despite lapse of time.

These results indicate that the photosensitive member prepared in the present example according to the invention exhibits outstanding performance, although the present member is slightly lower in electrostatic characteristics than those in Examples 1 to 3. When the member was used in the Carlson process for forming images thereon, followed by image transfer, sharp copy images were obtained.

COMPARATIVE EXAMPLE 1

The photosensitive member was prepared by exactly the same process as in Example 1 except that $H_2S$ gas was not introduced in CTL step.

When subjected to CHN quantitative analysis, the a-C layer thus obtained was found to contain 55 atomic % of hydrogen atoms based on the combined amount of carbon atoms and hydrogen atoms. However, the chalcogen atoms, i.e., sulfur atoms were not found in the a-C layer. Moreover, the thickness of the a-C layer was 4.9 microns.

Characteristics

When the photosensitive member obtained was used for the usual Carlson process, the member showed a Vmax of −500V. Specifically, the C.A. of the member was 96V by calculating from the entire thickness of the member, i.e. 5.2 microns, indicating that the member had satisfactory charging properties.

The period of time required for dark decay from −500 V to −450 V was about 15 seconds, showing that the member had satisfactory charge retentivity.

However, when the member was initially charged to −500 V and thereafter exposed to white light to decay the charge to −100 V, the amount of light required for the light decay was about 7.3 lux-sec. On the other hand, the member did not attain a half-reduced value with the light exposure of about 50 lux-sec. after three months upon the formation of the present photosensitive member. This showed that the member was poor in stabilized characteristics over a prolonged period of time free of deterioration despite lapse of time. This substantiates the superiority of the a-C layer of the invention prepared by doping preferable amount of chalcogen.

COMPARATIVE EXAMPLE 2

The photosensitive member was prepared by exactly the same process as in Example 1 except that the flow rate of $H_2S$ gas was set to 200 sccm in CTL step.

The a-C layer thus obtained was poor in ability for film-forming due to the excess amount of chalcogen. Further, the layer was partly separated from the substrate.

When subjected to CHN quantitative analysis, the a-C layer thus obtained was found to contain 54 atomic % of hydrogen atoms based on the combined amount of carbon atoms and hydrogen atoms and 10.2 atomic % of chalcogen atoms, i.e., sulfur atoms based on all the constituent atoms therein.

Characteristics

When the photosensitive member obtained was used for the usual Carlson process, the member showed a Vmax of −150 V. Specifically, the C.A. of the member was 14 V by calculating from the entire thickness of the member, i.e. 10.6 microns, indicating that the member was poor in charging properties.

When the member was initially charged to −150 V and thereafter exposed to white light to decay the charge, the member did not attain a half-reduced value with the light exposure of about 50 lux-sec. This showed that the member was poor in photosensitive characteristics and was found unusable. These results substantiate the superiority of the a-C layer of the invention prepared by doping preferable amount of chalcogen as shown in Examples 1 to 4.

EXAMPLE 5

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 7 was used. First, the interior of the reactor 733 was evacuated to a high vacuum of about $10^{-6}$ torr, and the first and third regulator valves 707 and 709 were thereafter opened to introduce hydrogen gas from the first tank 701 into the first flow controller 713 and $H_2Se$ gas from the third tank 703 into the third flow controller 715, each at an output pressure of 1.0 kg/cm$^2$. At the same time, the seventh regulator valve 725 was opened and styrene, heated at a temperature of 50° C. by the first heater 722 was introduced into the seventh flow controller 728 from the first container 719. The dials on the flow controllers were adjusted to supply the hydrogen gas at a flow rate of 40 sccm, the $H_2Se$ gas at a flow rate of 10 sccm and the styrene gas at 20 sccm to the reactor 733 through the main pipe 732 via the intermediate mixer 731. After the flows of the gases were stabilized, the internal pressure of the reactor 733 was adjusted to 0.7 torr by the pressure control valve 745. On the other hand, the substrate 752, which was an aluminum substrate measuring 50 mm in length, 50 mm in width and 3 mm in thickness, was preheated to 90° C. With the gas flow rates and the pressure in stabilized state, 200-watt power with a frequency of 50 KHz was applied to the power application electrode 736 from the low-frequency power source 741 preconnected thereto by the selecting switch 744 to conduct plasma polymerization for 1 hour, forming an a-C layer, 20.7 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 37 atomic % of hydrogen atoms based on the combined amount of carbon atoms and hydrogen atoms and 1.5 atomic % of chalcogen atoms, i.e., selenium atoms based on all the constituent atoms therein. Charge Generating Layer Forming Step (CGL)

Next, the a-Si:H charge generating layer having a thickness of about 0.3 microns was formed by the same process as in Example 1.

Characteristics

When the photosensitive member obtained was used for the usual Carlson process, the member showed a Vmax of −1000 V, indicating that the member had satisfactory charging properties.

The period of time required for dark decay from −600 V to −550 V was about 15 seconds, showing that the member had satisfactory charge retentivity.

When the member was initially charged to −500 V and thereafter exposed to white light to decay the charge to −100 V, the amount of light required for the light decay was about 5.0 lux-sec. This revealed that the member was satisfactory in photosensitive characteristics. The amount of light required for the light decay as described above was about 9.5 lux-sec. after three months upon the formation of the present photosensitive member. This showed that the member had stabilized characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 6

The photosensitive member was prepared by the same manner as in Example 5 except that the flow rate of $H_2Se$ gas was set to 20 sccm in CTL step.

When subjected to CHN quantitative analysis, the a-C layer thus obtained was found to contain 41 atomic % of hydrogen atoms based on the combined amount of carbon atoms and hydrogen atoms and 2.9 atomic % of chalcogen atoms, i.e., selenium atoms based on all the constituent atoms therein. The thickness of the member was about 21.5 microns.

Characteristics

When the photosensitive member obtained was used for the usual Carlson process, the member showed a Vmax of −1000 V, indicating that the member had satisfactory charging properties.

The period of time required for dark decay from −600 V to −550 V was about 20 seconds, showing that the member had satisfactory charge retentivity.

When the member was initially charged to −500 V and thereafter exposed to white light to decay the charge to −100 V, the amount of light required for the light decay was about 4.9 lux-sec. This revealed that the member was satisfactory in photosensitive characteristics. The amount of light required for the light decay as described above was about 5.2 lux-sec. after three months upon the formation of the present photosensitive member. This showed that the member had stabilized characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 7

The photosensitive member was prepared by the same manner as in Example 5 except that the flow rate of $H_2Se$ was set to 30 sccm.

When subjected to CHN quantitative analysis, the a-C layer thus obtained was found to contain 42 atomic % of hydrogen atoms based on the combined amount of carbon atoms and hydrogen atoms and 4.2 atomic % of chalcogen atoms, i.e., selenium atoms based on all the constituent atoms therein. The thickness of the member was about 23.3 microns.

Characteristics

When the photosensitive member obtained was used for the usual Carlson process, the member showed a Vmax of −1000 V, indicating that the member had satisfactory charging properties.

The period of time required for dark decay from −600 V to −550 V was about 20 seconds, showing that the member had satisfactory charge retentivity.

When the member was initially charged to −500 V and thereafter exposed to white light to decay the charge to −100 V, the amount of light required for the light decay was about 7.6 lux-sec. This revealed that the member was satisfactory in photosensitive characteristics. The amount of light required for the light decay as described above was about 8.4 lux-sec. after three months upon the formation of the present photosensitive member. This showed that the member had stabilized characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 8

The photosensitive member was prepared by the same manner as in Example 5 except that the flow rate of $H_2Se$ gas was set to 100 sccm in CTL step.

When subjected to CHN quantitative analysis, the a-C layer thus obtained was found to contain 44 atomic % of hydrogen atoms based on the combined amount of carbon atoms and hydrogen atoms and 8.9 atomic % of chalcogen atoms, i.e., selenium atoms based on all the constituent atoms therein. The thickness of the member was about 25.0 microns.

Characteristics

When the photosensitive member obtained was used for the usual Carlson process, the member showed a Vmax of −700 V. Specifically, the C.A. of the member was about 28 V by calculating from the entire thickness of the member, i.e., 25.3 microns, indicating that the member had satisfactory charging properties.

The period of time required for dark decay from −600 V to −550 V was about 25 seconds, showing that the member had satisfactory charge retentivity.

When the member was initially charged to −500 V and thereafter exposed to white light to decay the charge to −100 V, the amount of light required for the light decay was about 8.2 lux-sec. This revealed that the member was satisfactory in photosensitive characteristics. The amount of light required for the light decay as described above was about 9.9 lux-sec. after three months upon the formation of the present photosensitive member. This showed that the member had stabilized characteristics over a prolonged period of time free of deterioration despite lapse of time.

These results indicate that the photosensitive member prepared in the present example according to the invention exhibits outstanding performance, although the member was slightly lower in electrostatic characteristics than those of Examples 5 to 7. When the member was used in the Carlson process for forming images thereon, followed by image transfer, sharp copy images were obtained.

COMPARATIVE EXAMPLE 3

The photosensitive member was prepared by exactly the same process as in Example 5 except that $H_2Se$ gas was not introduced in CTL step.

When subjected to CHN quantitative analysis, the a-C layer thus obtained was found to contain 43 atomic % of hydrogen atoms based on the combined amount of carbon atoms and hydrogen atoms. However, the chalcogen atoms, i.e., selenium atoms were not found in the a-C layer. Moreover, the thickness of the a-C layer was 15.3 microns.

Characteristics

When the photosensitive member obtained was used for the usual Carlson process, the member showed a Vmax of −1000 V, indicating that the member had satisfactory charging properties.

The period of time required for dark decay from −600 V to −550 V was about 15 seconds, showing that the member had satisfactory charge retentivity.

When the member was initially charged to −500 V and thereafter exposed to white light to decay the charge to −100 V, the amount of light required for the light decay was about 7.1 lux-sec. On the other hand, the member did not attain a half-reduced value with the light exposure of about 50 lux-sec. after three months upon the formation of the present photosensitive member. This showed that the member was poor in stabilized characteristics over a prolonged period of time free of deterioration despite lapse of time. This substantiates the superiority of the a-C layer of the invention prepared by doping preferable amount of chalcogen atoms, i.e., selenium atoms as shown in Examples 5 to 8.

COMPARATIVE EXAMPLE 4

The photosensitive member was prepared by exactly the same process as in Example 5 except that the flow rate of $H_2Se$ gas was set to 150 sccm in CTL step.

The a-C layer thus obtained was poor in ability for film-forming and found that the layer had partly an oily film. Further, the thickness of the layer was 27.5 microns.

When subjected to CHN quantitative analysis, the a-C layer thus obtained was found to contain 39 atomic % of hydrogen atoms based on the combined amount of carbon atoms and hydrogen atoms and 10.4 atomic % of chalcogen atoms, i.e., selenium atoms based on all the constituent atoms therein.

Characteristics

When the photosensitive member obtained was used for the usual Carlson process, the member showed a Vmax of −350 V. Specifically, the C.A. of the member was 13 V by calculating from the entire thickness of the member, i.e. 27.8 microns, indicating that the member was poor in charging properties.

When the member was initially charged to −350 V and thereafter exposed to white light to decay the charge, the member did not attain a half-reduced value with the light exposure of about 50 lux-sec. This showed that the member was poor in photosensitive characteristics and was found unusable. These results substantiate the superiority of the a-C layer of the invention prepared by doping preferable amount of chalcogen as shown in Examples 5 to 8.

EXAMPLE 9

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 8 was used. First, the interior of the reactor 733 was evacuated to a high vacuum of about $10^{-6}$ torr, and the first and second regulator valves 707 and 708 were thereafter opened to introduce hydrogen gas from the first tank 701 into the first flow controller 713 and propylene gas from the second tank 702 into the second flow controller 714, each at an output pressure of 1.0 kg/cm$^2$. At the same time, the seventh and eighth regulator valves 725 and 726 were opened, and styrene gas, heated at a temperature of 70° C. by the first heater 722 was introduced into the seventh flow controller 728 from the first container 719. Further, the third regulator valves 726 was opened to introduce $H_2Te$ gas from the third tank 703 into the third flow controller 729. The dials on the flow controllers were adjusted to supply the hydrogen gas at a flow rate of 200 sccm, the propylene gas at 130 sccm, the styrene gas at 50 sccm and the $H_2Te$ gas at 5 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate having a diameter of 80 mm and a length of 350 mm, was preheated to 200° C. With the gas flow rates and the pressure in stabilized state, 250-watt power with a frequency of 13.56 MHz was applied to the power application electrode 736 from the high-frequency power source 739 which was connected to the electrode by the connection selecting switch 744 in advance to conduct plasma polymerization for 2 hours, forming an a-C layer, 20.0 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 47 atomic % of hydrogen atoms based on the combined amount of carbon atoms and hydrogen atoms and 0.5 atomic % of.chalcogen atoms, i.e., tellurium atoms based on all the constituent atoms therein.

Charge Generating Layer Forming Step (CGL)

Next, the first, fourth, fifth and sixth regulator valves 707, 710, 711 and 712 were opened to introduce hydrogen gas from the first tank 701 into the first flow controller 713, nitrous oxide gas from the fourth tank 704 into the fourth flow controller 716, diborane gas which was diluted to the concentration of 50 ppm with hydrogen gas into the fifth flow controller 717 from the fifth tank 705 and silane gas from the sixth tank 706 into the sixth flow controller 718, each at an output pressure of 1.0 kg/cm$^2$. The dials on the flow controllers were adjusted to supply the hydrogen gas at a flow rate of 300 sccm, the nitrous oxide gas at 1.0 sccm, the diborane gas diluted to the concentration of 50 ppm with hydrogen gas at a flow rate of 10 sccm and the silane gas at 100 sccm to the reactor 733. After the flows of the gases stabilized, the internal pressure of the reactor 733 was adjusted to 1.0 torr by the pressure control valve 745. On the other hand, the substrate 752 formed with the a-C layer was preheated to 250° C. With the gas flow rates and the pressure in stabilized state, 200-watt power with a frequency of 13.56 MHz was applied to the power application electrode 736 from the high-frequency power source 739 to effect glow discharge for 5 minutes, whereby a charge generating a-Si:B:H layer was formed with a thickness of 0.3 microns.

Characteristics

When the photosensitive member obtained was used for the usual Carlson process, the member showed a Vmax of +1000 V, indicating that the member had satisfactory charging properties.

The period of time required for dark decay from +600 V to +550 V was about 20 seconds, showing that the member had satisfactory charge retentivity.

When the member was initially charged to +500 V and thereafter exposed to white light to decay the charge to 100 V, the amount of light required for the light decay was about 6.9 lux-sec. This revealed that the member was satisfactory in photosensitive characteristics. The amount of light required for the light decay as described above was about 7.8 lux-sec. after three months upon the formation of the present photosensitive member. This showed that the member had stabilized characteristics over a prolonged period of time free of deterioration despite lapse of time.

These results indicate that the photosensitive member prepared in the present example according to the invention exhibits outstanding performance When the member was used in the Carlson process for forming images thereon, followed by image transfer, sharp copy images were obtained.

EXAMPLE 10

The photosensitive member was prepared by the same manner as in Example 9 except that the flow rate of $H_2Te$ gas was set to 15 sccm in CTL step.

When subjected to CHN quantitative analysis, the a-C layer thus obtained was found to contain 42 atomic % of hydrogen atoms based on the combined amount of carbon atoms and hydrogen atoms and 2.3 atomic % of chalcogen atoms, i.e., tellurium atoms based on all the constituent atoms therein. The thickness of the member was about 21.5 microns.

Characteristics

When the photosensitive member obtained was used for the usual Carlson process, the member showed a Vmax of +1000 V, indicating that the member had satisfactory charging properties.

The period of time required for dark decay from +600 V to +550 V was about 15 seconds, showing that the member had satisfactory charge retentivity.

When the member was initially charged to +500 V and thereafter exposed to white light to decay the charge to +100 V, the amount of light required for the light decay was about 8.0 lux-sec. This revealed that the member was satisfactory in photosensitive characteristics. The amount of light required for the light decay as described above was about 6.3 lux-sec. after three months upon the formation of the present photosensitive member This showed that the member had stabilized characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 11

The photosensitive member was prepared by the same manner as in Example 9 except that the flow rate of $H_2Te$ gas was set to 30 sccm in CTL step.

When subjected to CHN quantitative analysis, the a-C layer thus obtained was found to contain 47 atomic % of hydrogen atoms based on the combined amount of carbon atoms and hydrogen atoms and 5.9 atomic % of chalcogen atoms, i.e., tellurium atoms based on all the constituent atoms therein. The thickness of the member was about 24.8 microns.

Characteristics

When the photosensitive member obtained was used for the usual Carlson process, the member showed a Vmax of +1000 V, indicating that the member had satisfactory charging properties.

The period of time required for dark decay from +600 V to +550 V was about 20 seconds, showing that the member had satisfactory charge retentivity.

When the member was initially charged to +500 V and thereafter exposed to white light to decay the charge to 100 V, the amount of light required for the light decay was about 8.1 lux-sec. This revealed that the member was satisfactory in photosensitive characteristics. The amount of light required for the light decay as described above was about 9.1 lux-sec. after three months upon the formation of the present photosensitive member. This showed that the member had stabilized characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 12

The photosensitive member was prepared by the same manner as in Example 9 except that the flow rate of $H_2Te$ gas was set to 105 sccm.

When subjected to CHN quantitative analysis, the a-C layer thus obtained was found to contain 46 atomic % of hydrogen atoms based on the combined amount of carbon atoms and hydrogen atoms and 9.2 atomic % of chalcogen atoms, i.e., tellurium atoms based on all the constituent atoms therein. The thickness of the member was about 25 microns.

Characteristics

When the photosensitive member obtained was used for the usual Carlson process, the member showed a Vmax of +700 V. Specifically, the C.A. of the member was about 28 V by calculating from the entire thickness, i.e., 25.3 microns, indicating that the member had satisfactory charging properties.

The period of time required for dark decay from +600 V to +550 V was about 25 seconds, showing that the member had satisfactory charge retentivity.

When the member was initially charged to +500 V and thereafter exposed to white light to decay the charge to +100 V, the amount of light required for the light decay was about 9.1 lux-sec. This revealed that the member was satisfactory in photosensitive characteristics. The amount of light required for the light decay as described above was about 12.3 lux-sec. after three months upon the formation of the present photosensitive member. This showed that the member had stabilized characteristics over a prolonged period of time free of deterioration despite lapse of time.

These results indicate that the photosensitive member prepared in the present example according to the invention exhibits outstanding performance, although the member of the present example was slightly lower in electrostatic characteristics than those of Examples 9 to 11. When the member was used in the Carlson process for forming images thereon, followed by image transfer, sharp copy images were obtained.

COMPARATIVE EXAMPLE 5

The photosensitive member was prepared by exactly the same process as in Example 9 except that $H_2Te$ gas was not introduced in CTL step.

When subjected to CHN quantitative analysis, the a-C layer thus obtained was found to contain 48 atomic % of hydrogen atoms based on the combined amount of carbon atoms and hydrogen atoms. However, the chalcogen atoms, i.e. tellurium atoms were not found in the a-C layer. Moreover, the thickness of the a-C layer was 19.5 microns.

Characteristics

When the photosensitive member obtained was used for the usual Carlson process, the member showed a Vmax of +1000 V, indicating that the member had satisfactory charging properties.

The period of time required for dark decay from +600 V to +550 V was about 20 seconds, showing that the member had satisfactory charge retentivity.

When the member was initially charged to +500 V and thereafter exposed to white light to decay the charge to +100 V, the amount of light required for the light decay was about 7.4 lux-sec. On the other hand, the member did not attain a half-reduced value with the light exposure of about 50 lux-sec. after three months upon the formation of the present photosensitive member. This showed that the member was poor in stabilized characteristics over a prolonged period of time free of deterioration despite lapse of time. This substantiates the superiority of the a-C layer of the invention prepared by doping preferable amount of chalcogen atoms, i.e., tellurium atoms.

COMPARATIVE EXAMPLE 6

The photosensitive member was prepared by exactly the same process as in Example 9 except that the flow rate of $H_2Te$ gas was set to 130 sccm.

The a-C layer thus obtained was poor in ability for film-forming and the charge transporting layer in a solid state could hardly be obtained. The thickness could not be accurately obtained.

When subjected to CHN quantitative analysis, the thin a-C layer thus obtained was found to contain 45 atomic % of hydrogen atoms based on the combined amount of carbon atoms and hydrogen atoms and 11.1 atomic % of chalcogen atoms, i.e., tellurium atoms based on all the constituent atoms therein.

As apparent from the above, the amount of chalcogen contained in the charge transporting layer was important in view of the film-forming.

EXAMPLE 13 Charge Generating Layer Forming Step (CGL)

Using heat resistance method, the distance between the substrate and the heating boat was set to about 35 cm and the bell jar was evacuated to a high vacuum of about $10^{-7}$ torr. Thereafter, the electric current was applied to the boat to evaporate TiOPc thereon under the boat temperature of 480° C., forming on the substrate (room temperature) TiOPc evaporated film having a thickness of 0.35 microns as a charge generating layer.

Charge Transporting Layer Forming Step (CTL)

Next, the a-C layer having a thickness of 17 microns was formed by the same manner as in Example 5.

When subjected to CHN quantitative analysis, the a-C layer thus obtained was found to contain 37 atomic % of hydrogen atoms based on the combined amount of carbon atoms and hydrogen atoms and 1.5 atomic % of chalcogen atoms, i.e., selenium atoms based on all the constituent atoms therein.

Characteristics

When the photosensitive member obtained was used for the usual Carlson process, the member showed a Vmax of −900 V, indicating that the member had satisfactory charging properties.

The period of time required for dark decay from −600 V to −550 V was about 17 seconds, showing that the member had satisfactory charge retentivity.

When the member was initially charged to −500 V and thereafter exposed to semiconductive laser light having a wavelength of 780 nm to −100 V, the amount of light required for the light decay was about 8.1 erg/cm$^2$. This revealed that the member was satisfactory in photosensitive characteristics. The amount of light required for the light decay as described above was about 8.3 lux-sec. after three months upon the formation of the present photosensitive member. This showed that the member had stabilized characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 14

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 7 was used. First, the interior of the reactor 733 was evacuated to a high vacuum of about $10^{-6}$ torr, and the first and second regulator valves 707 and 708 were thereafter opened to introduce hydrogen gas from the first tank 701 into the first flow controller 713 and acetylene gas from the second tank 702 into the second flow controller 714, each at an output pressure of 1.0 Kg/cm$^2$. At the same time, the seventh regulator valve 725 was opened and iron pentacarbonyl gas ($Fe(Co)_5$) heated at a temperature of 160° C. by the first heater 722 was introduced into the first, second and seventh flow controllers 713, 714 and 728 from the first container 719. The dials on the flow controllers were adjusted to supply the hydrogen gas at a flow rate of 40 sccm, the acetylene gas at 40 sccm and the iron pentacarbonyl gas at 1 sccm to the reactor 733 through the main pipe 732 via the intermediate mixer 731. After the flows of the gases were stabilized, the internal pressure of the reactor 733 was adjusted to 0.9 torr by the pressure control valve 745. On the other hand, the substrate 752, which was an aluminum substrate measuring 50 mm in length, 50 mm in width and 3 mm in thickness, was preheated to 200° C. With the gas flow rates and the pressure in stabilized state, 200-watt power with a frequency of 5 MHz was applied to the power application electrode 736 from the high-frequency power source 739 preconnected thereto by the selecting switch 744 to conduct plasma polymerization for 4 hours, forming an a-C layer, 14 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 49 atomic % of hydrogen atoms based on the combined amount of carbon atoms and hydrogen atoms and 0.1 atomic % of transition metal elements, i.e., iron atoms based on all the constituent atoms therein.

Charge Generating Layer Forming Step (CGL)

Next, the first and sixth regulator valves 707 and 712 were opened to introduce hydrogen gas from the first tank 701 into the first flow controller 713 and silane gas from the sixth tank 706 into the sixth flow controller 718, each at an output pressure of 1.0 kg/cm$^2$. The dials on the flow controllers were adjusted to supply the hydrogen as at a flow rate of 100 sccm and the silane gas at 65 sccm to the reactor 733. After the flows of the gases stabilized, the internal pressure of the reactor 733 was adjusted to 0.8 torr by the pressure control valve 745. On the other hand, the substrate 752 formed with the a-C layer was preheated to 250° C. With the gas flow rates and the pressure in stabilized state, 200-watt power with a frequency of 13.56 MHz was applied to the power application electrode 736 from the high-frequency power source 739 to effect glow discharge for 20 minutes, whereby a charge generating a-Si:H layer was formed with a thickness of 0.4 microns.

Characteristics

When the photosensitive member obtained was used for the usual Carlson process, the member showed a Vmax of −700 V. Specifically, the C.A. was 45.5 V/microns by calculating from the entire thickness of the member, i.e. 15.4 microns, indicating that the member had satisfactory charging properties.

The period of time required for dark decay from Vmax to the potential corresponding to 90% of Vmax (hereinafter referred to as Td) was about 20 seconds, showing that the member has satisfactory charge retentivity.

The amount of light required for the light decay from Vmax to the potential corresponding to 20% of Vmax with white light (hereinafter referred to as E) was about 6.2 lux-sec, showing that the member was satisfactory in photosensitive characteristics.

These results indicate that the photosensitive member prepared in the present example according to the invention exhibits outstanding performance. When the member was used in the Carlson process for forming images thereon, followed by image transfer, sharp copy images were obtained.

EXAMPLES 15 TO 19

The photosensitive members were prepared by exactly the same process as in Example 14 except that the flow rates of iron pentacarbonyl gas were respectively set to 2.0 (Example 15), 3.5 (Example 16), 6 (Example 17), 10 (Example 18) and 15 (Example 19) sccm by controlling the temperature of the first heater 722 and the degree of opening of the seventh flow controller 728.

The thicknesses of the a-C layers were respectively 14, 12, 10.9, 10.2 and 11 microns. When subjected to CHN quantitative analysis, the a-C layers thus obtained were found to contain 46, 41, 38.3, 36.2 and 33,2 atomic % of hydrogen atoms based on the combined amount of carbon atoms and hydrogen atoms and further, 0.3, 0.9, 2.8, 5 and 10 atomic % of transition elements, i.e., iron atoms based on all the constituent atoms therein.

Characteristics

When the photosensitive members obtained were used for the usual Carlson process, the members respectively showed Vmax of −700 V, −660, −510, −420 and −300 V. Specifically, the C.A. were respectively 48.6, 53.2, 45.1, 40.6 and 26.3 V/μm by calculating from the entire thickness of the members, i.e. 14.4, 12.4, 11.3, 10.6 and 11.6 microns, indicating that the members had satisfactory charging properties.

The Td were 20, 15, 10, 8 and 5 seconds respectively, showing that the members had satisfactory charge retentivity.

The E were 5.8, 3.2, 1.9, 7.2 and 9.4 lux-sec respectively. This revealed that the members were satisfactory in photosensitive characteristics.

These results indicate that th photosensitive members prepared in the present examples according to the invention exhibits outstanding performance. When the members were used in the Carlson process for forming images thereon, followed by image transfer, sharp copy images were obtained.

COMPARATIVE EXAMPLE 7

The photosensitive member was prepared by exactly the same process as in Example 14 except that iron pentacarbonyl gas was not introduced in CTL step.

When subjected to CHN quantitative analysis, the a-C layer thus obtained was found to contain 51 atomic % of hydrogen atoms based on the combined amount of carbon atoms and hydrogen atoms However, the transition metal elements, i.e., iron atoms were not found in the a-C layer.

Characteristics

When the photosensitive member obtained was used for the usual Carlson process, the member showed a Vmax or −750 V. Specifically, the chargeability per 1 micron was 65.2 V/micron by calculating from the entire thickness of the member, i.e. 11.5 microns, indicating that the member had satisfactory charging properties.

The Td was 25 seconds, showing that the member has satisfactory charge retentivity.

The E was 12.6 lux-sec, which was slight lower, but the member was found to be used without any problem.

However, the member did not attain a half-reduced value with the light exposure of about 50 lux-sec. after three months upon the formation of the present photosensitive member. This showed that the member was poor in stabilized characteristics over a prolonged period of time free of deterioration despite lapse of time. This substantiates the superiority of the a-C layer of the invention prepared by doping preferable amount of transition metal elements.

COMPARATIVE EXAMPLE 8

The photosensitive member was prepared by exactly the same process as in Example 14 except that the flow rate of acetylene gas was set to 20 sccm and the flow rate of iron pentacarbonyl gas was set to 20 sccm in CTL step.

When subjected to CHN quantitative analysis, the a-C layer thus obtained was found to contain 31.5 atomic % of hydrogen atoms based on the combined amount of carbon atoms and hydrogen atoms and 11.9 atomic % of transition metal elements, i.e., iron atoms based on all the constituent atoms therein.

Characteristics

When the photosensitive member obtained was used for the usual Carlson process, the member showed a Vmax of −150 V. Specifically, the C.A. of the member was 12.2 V by calculating from the entire thickness of the member, i.e. 12.3 microns, indicating that the member was poor in charging properties.

This showed that the member was poor in photosensitive characteristics and was found unusable. These results substantiate the superiority of the a-C layer of the invention prepared by doping preferable amount of transition metal elements.

EXAMPLE 20

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 7 was used. First, the interior of the reactor 733 was evacuated to a high vacuum of about $10^{-6}$ torr, and the first and second regulator valves 707 and 708 were thereafter opened to introduce hydrogen gas from the first tank 701 into the first flow controller 713 and butadiene gas from the second tank 702 into the second flow controller 714, each at an output pressure of 1.0 kg/cm$^2$. At the same time, the seventh regulator valve 725 was opened and molybdenum hexacarbonyl($Mo(Co)^6$) heated at a temperature of 130° C. by the first heater 722 was introduced into the first, second and seventh flow controllers 713, 714 and 728 from the first container 719. The dials on the flow controllers were adjusted to supply the hydrogen gas at a flow rate of 60 sccm, the butadiene gas at a flow rate of 60 sccm and the molybdenum hexacarbonyl gas at 5 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate measuring 50 mm in length, 50 mm in width and 3 mm in thickness, was preheated to 100° C. With the gas flow rates and the pressure in stabilized state, 100-watt power with a frequency of 300 KHz was applied to the power application electrode 736 from the low-frequency power source 741 preconnected thereto by the selecting switch 744 to conduct plasma polymerization for 30 minutes, forming an a-C layer, 8 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 41 atomic % of hydrogen atoms based on the combined amount of carbon atoms and hydrogen atoms and 2.8 atomic % of transition metal elements, i.e., Mo atoms based on all the constituent atoms therein.

Charge Generating Layer Forming Step (CGL)

Next, the a-Si:H charge generating layer was formed by the same process as in Example 14 except that a nitrous oxide gas was introduced from the fifth tank 705 at a flow rate of 0.1 sccm.

Characteristics

When the photosensitive member obtained was used for the usual Carlson process, the member showed a Vmax of −700 V Specifically, the chargeability per 1 micron was 83.3 V/micron by calculating from the entire thickness of the member, i.e. 8.4 microns, indicating that the member had satisfactory charging properties.

The Td was about 15 seconds, showing that the member had satisfactory charge retentivity.

The E was about 2.1 lux-sec. This revealed that the member was satisfactory in photosensitive characteristics.

These results indicate that the photosensitive member prepared in the present example according to the invention exhibits outstanding performance. When the member was used in the Carlson process for forming images thereon, followed by image transfer, sharp copy images were obtained.

EXAMPLE 21

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 8 was used. First, the interior of the reactor 733 was evacuated to a high vacuum of about $10^{-6}$ torr, and the first regulator valve 707 was thereafter opened to introduce hydrogen gas from the first tank 701 into the first flow controller 713 at an output pressure of 1.0 kg/cm$^2$. At the same time, the seventh and eighth regulator valves 725 and 726 were opened, and tungsten hexacarbonyl ($W(CO)^6$) gas, heated at a temperature of 145° C. by the first heater 722 and styrene gas, heated at a temperature of 50° C. by the second heater 723 were introduced into the first, seventh and eighth flow controllers 713, 728 and 729 from the first and second containers 719 and 720 respectively. The dials on the flow controllers were adjusted to supply the hydrogen gas at a flow rate of 40 sccm, the styrene gas at 40 sccm and the tungsten hexacarbonyl gas at 2.5 sccm to the reactor 733 through the main pipe 732 via the intermediate mixer 731. After the flows of the gases were stabilized, the internal pressure of the reactor 733 was adjusted to 0.6 torr by the pressure control valve 745. On the other hand, the substrate 752, which was an aluminum substrate having a diameter of 80 mm and a length of 330 mm, was preheated to 120° C. With the gas flow rates and the pressure in stabilized state, 130-watt power with a frequency of 50 KHz was applied to the power application electrode 736 from the low-frequency power source 741 which was connected to the electrode by the connection selecting switch 744 in advance to conduct plasma polymerization for 1 hour and 10 minutes, forming an a-C layer, 16.0 microns in thickness, as a charge transporting layer on the substrate, whereupon the power supply was discontinued, the regulator valves were closed, and the reactor 733 was fully exhausted When subjected to CHN quantitative analysis, the a-C layer thus obtained was found to contain 42 atomic % of hydrogen atoms based on the combined amount of carbon atoms and hydrogen atoms and 2.2 atomic % of transition metal elements, i.e., W atoms based on all the constituent atoms therein.

Charge Generating Layer Forming Step (CGL)

Next, the first, fifth and sixth regulator valves 707, 711 and 712 were opened to introduce hydrogen gas from the first tank 701 into the first flow controller 713, nitrous oxide gas into the fifth flow controller 717 from the fifth tank 705 and silane gas from the sixth tank 706 into the sixth flow controller 718, each at an output pressure of 1.0 kg/cm2 The dials on the flow controllers were adjusted to supply the hydrogen gas at a flow rate of 300 sccm, the nitrous oxide gas at 1.0 sccm and the silane gas at 90 sccm to the reactor 733. After the flows of the gases stabilized, the internal pressure of the reactor 733 was adjusted to 1.0 torr by the pressure control valve 745. On the other hand, the substrate 752 formed with the a-C layer was preheated to 235° C. With the gas flow rates and the pressure in stabilized state, 200-watt power with a frequency of 13.56 MHz was applied to the power application electrode 736 from the high-frequency power source 739 to effect glow discharge for 15 minutes, whereby a charge generating a-Si:H layer was formed with a thickness of 0.4 microns.

Characteristics

When the photosensitive member obtained was used for the usual Carlson process, the member showed a Vmax of −650 V. Specifically, the chargeability per 1 micron was 39.6 V/micron by calculating from the entire thickness of the member, i.e. 16.4 microns, indicating that the member had satisfactory charging properties.

The Td was about 10 seconds, showing that the member had satisfactory charge retentivity.

The E was about 2.1 lux-sec. This revealed that the member was satisfactory in photosensitive characteristics.

These results indicate that the photosensitive member prepared in the present example according to the invention exhibits outstanding performance. When the member was used in the Carlson process for forming images thereon, followed by image transfer, sharp copy images were obtained.

EXAMPLE 22

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL)

The glow discharge decomposition apparatus shown in FIG. 7 was used. First, the interior of the reactor 733 was evacuated to a high vacuum of about $10^{-6}$ torr, and the first and second regulator valves 707 and 708 were thereafter opened to introduce hydrogen gas from the first tank 701 into the first flow controller 713 and propylene gas from the second tank 702 into the second flow controller 714, each at an output pressure of 1.0 kg/cm$^2$. At the same time, the seventh regulator valve 725 was opened and tetra-n-propylorthotitanate ((n-$C_3H_7O$)Ti) gas, heated at a temperature of 225° C. by the first heater 722 was introduced into the first, second and seventh flow controllers 713, 714 and 728 from the first container 719. The dials on the flow controllers were adjusted to supply the hydrogen gas at a flow rate of 40 sccm, the propylene gas at a flow rate of 40 sccm and the tetra-n-propylorthotitanate gas at 0.5 sccm to the reactor 733 through the main pipe 732 via the intermediate mixer 731. After the flows of the gases were stabilized, the internal pressure of the reactor 733 was adjusted to 0.4 torr by the pressure control valve 745. On the other hand, the substrate 752, which was an aluminum substrate measuring 50 mm in length, 50 mm in width and 3 mm in thickness, was preheated to 150° C. With the gas flow rates and the pressure in stabilized state, 120-watt power with a frequency of 4.0 MHz was applied to the power application electrode 736 from the high-frequency power source 739 preconnected thereto by the selecting switch 744 to conduct plasma polymerization for 4 hours, forming an a-C layer, 5 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 38 atomic % of hydrogen atoms based on the combined amount of carbon atoms and hydrogen atoms and 0.9 atomic % of transition metal elements, i.e., Ti atoms based on all the constituent atoms therein.

Charge Generating Layer Forming Step (CGL)

Next, the a-Si:H charge generating layer was formed by the same process as in Example 14 except that a nitrous oxide gas was introduced from the fifth tank 705 at a flow rate of 0.1 sccm.

Characteristics

When the photosensitive member obtained was used for the usual Carlson process, the member showed a Vmax of −450 V. Specifically, the chargeability per 1 micron was 83.3 V/micron by calculating from the entire thickness of the member, i.e. 5.4 microns, indicating that the member had satisfactory charging properties.

The Td was about 25 seconds, showing that the member had satisfactory charge retentivity.

The E was about 1.5 lux-sec. This revealed that the member was satisfactory in photosensitive characteristics.

These results indicate that the photosensitive member prepared in the present example according to the invention exhibits outstanding performance. When the member was used in the Carlson process for forming images thereon, followed by image transfer, sharp copy images were obtained.

EXAMPLE 23

The photosensitive member was prepared by the same manner as in Example 16 except that the order of the CGL step and the CTL step was replaced. Thus formed photosensitive member comprised an electrically conductive substrate, a charge generating layer and a charge transporting layer provided in this order as shown in FIG. 2.

Characteristics

When the photosensitive member obtained was used for the usual Carlson process, the member showed a Vmax of +680 V. Specifically, the C.A. was 54.8 V/microns by calculating from the entire thickness of the member, i.e., 12.4 microns, indicating that the member had satisfactory charging properties.

The Td was about 15 seconds, showing that the member had satisfactory charge retentivity.

These results indicate that the photosensitive member prepared in the present example according to the invention exhibits outstanding performance. When the member was used in the Carlson process for forming images thereon, followed by image transfer, sharp copy images were obtained.

EXAMPLE 24

Employing an evaporated film as a charge generating layer, a photosensitive member was prepared, said member comprising an electrically conductive substrate, a charge generating layer and a charge transporting layer provided in this order as shown in FIG. 2.

Charge Generating Layer Forming Step (CGL)

Using a heat resistance method, an evaporated film of aluminum chlorophthalocyanine chloride (AlClPc(Cl)) was formed on an aluminum substrate with a thickness of about 1000 aungstroms. Thereafter, the evaporated film was exposed into the THF vapor for about 30 minutes to conduct a solution-vapor treatment, forming a charge generating layer. The aluminum chlorophthalocyanine chloride was evaporated for about 10 minutes under the boat temperature of 450° to 490° C. with the degree of vacuum set to $5\times10^{-5}$ to $1\times10^{-4}$ torr.

Charge Transporting Layer Forming Step (CTL)

Next, the a-C layer was formed on the evaporated film of aluminum chlorophthalocyanine chloride by the same manner as in Example 17 except that the substrate was heated to 60° C.

Characteristics

When the photosensitive member obtained was used for the usual Carlson process, the member showed a Vmax of +450 V. Specifically, the C.A. was 37.2 V/microns by calculating from the entire thickness of the member, i.e., 12.1 microns, indicating that the member had satisfactory charging properties.

The Td was about 15 seconds, showing that the member had satisfactory charge retentivity.

The E was about 2.3 lux/sec. This revealed that the member was satisfactory in photosensitive characteristics Further, the amount of light required for the light decay from Vmax to the potential corresponding to 20% of the Vmax by using semiconductive laser light having a wavelength of 780 nm was 7.6 erg/cm$^2$. This revealed that the member had excellent photosensitivity toward long wavelength light.

These results indicate that the photosensitive member prepared in the present example according to the invention exhibits outstanding performance. When the member was used in the Carlson process for forming images thereon, followed by image transfer, sharp copy images were obtained.

What is claimed is:

1. A photosensitive member comprising:
an electrically conductive substrate;
a charge generating layer; and
a charge transporting layer comprising amorphous carbon containing hydrogen in an amount in an amount of about 0.1 to about 67 atomic % based on the combined amount of hydrogen and carbon, said charge transporting layer containing about 0.1 to about 10 atomic % of chalcogen atoms or transition metal elements based on all the consistuent atoms in the layer.

2. A photosensitive member as claimed in claim 1, wherein said charge transporting layer has essentially no photoconductivity.

3. A photosensitive member as claimed in claim 1, wherein said charge transporting layer is prepared by organic plasma polymerization.

* * * * *

UNITED STATES PATENT AND TRADEMARK OFFICE

CERTIFICATE OF CORRECTION

PATENT NO. : 4,876,168

DATED : October 24, 1989

INVENTOR(S) : Hideo Hotomi; Izumi Osawa; Syuji Iino; Isao Doi; Masanori Fujiwara.

It is certified that error appears in the above-identified patent and that said Letters Patent is hereby corrected as shown below:

In the Title, correct the word "Chalogen" to --Chalcogen--.

Signed and Sealed this

Second Day of October, 1990

*Attest:*

HARRY F. MANBECK, JR.

*Attesting Officer*

*Commissioner of Patents and Trademarks*